US009303352B2

(12) United States Patent
Hasanreisoglu

(10) Patent No.: US 9,303,352 B2
(45) Date of Patent: Apr. 5, 2016

(54) WASHING MACHINE WHEREIN THE UNBALANCED LOAD IS BALANCED

(75) Inventor: Ali Levent Hasanreisoglu, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 657 days.

(21) Appl. No.: 13/699,287

(22) PCT Filed: May 16, 2011

(86) PCT No.: PCT/EP2011/057858
§ 371 (c)(1),
(2), (4) Date: Nov. 20, 2012

(87) PCT Pub. No.: WO2011/144559
PCT Pub. Date: Nov. 24, 2011

(65) Prior Publication Data

US 2013/0061639 A1 Mar. 14, 2013

(30) Foreign Application Priority Data

May 20, 2010 (TR) ..... A 2010 04003

(51) Int. Cl.
*D06F 37/22* (2006.01)
*D06F 37/06* (2006.01)
*D06F 37/20* (2006.01)

(52) U.S. Cl.
CPC ..... *D06F 37/225* (2013.01); *D06F 37/06* (2013.01); *D06F 37/203* (2013.01)

(58) Field of Classification Search
CPC ..... D06F 37/203; D06F 37/225; D06F 37/06
USPC ..... 68/12.06, 23.1, 23.2, 24, 139, 140, 141, 68/142, 143, 144
See application file for complete search history.

(56) References Cited

U.S. PATENT DOCUMENTS 2,534,267 A * 12/1950 Kahn ..... 74/572.4
2,534,268 A * 12/1950 Ellner et al. ..... 74/572.4

(Continued)

FOREIGN PATENT DOCUMENTS

| | | | |
|---|---|---|---|
| EP | 1693500 | A2 | 8/2006 |
| JP | 2002136792 | A | 5/2002 |
| WO | 2008125498 | A1 | 10/2008 |

*Primary Examiner* — Joseph L Perrin
(74) *Attorney, Agent, or Firm* — Venjuris P.C.

(57) ABSTRACT

A washing machine (1) is described comprising a hub (5) which extends from the middle of the rear wall of the tub (3) into the drum (2) and wherein the shaft (4) is supported, at least one drum baffle (9) disposed at the inner surface of the drum (2), wherein water is transferred in case of an unbalanced load, a cylindrical housing (6) disposed at the center of the rear wall of the drum (2) around the horizontal axis, surrounding the hub (5) concentrically such that a gap remains between the hub (5) and the cylindrical housing (6) and rotating together with the drum (2), more than one ring-shaped gasket (7) arranged one after the other and in parallel to each other in the gap between the housing (6) and the hub (5), the outer edges of which are secured to the inner surface of the housing (6), rotating together with the housing (6) and the inner edges of which contact the cylindrical outer surface of the hub (5), more than one slot (8) disposed between the gaskets (7), at least two water inlet lines (13, 113) which provide water taken from the water mains to be delivered to the slot (8) for the balancing process of the unbalanced load, one ends of which are connected to the water mains and the other ends connected to the slot (8) and which are stationary together with the tub (3) and a control unit (12) which opens/closes the water inlet valves (11, 111) by determining the amount and position of the unbalanced load when unbalanced load is detected and which determines how much water should be delivered into which drum baffle (9) and chamber (10, 110).

14 Claims, 6 Drawing Sheets

(56) References Cited

U.S. PATENT DOCUMENTS

Figure 1:
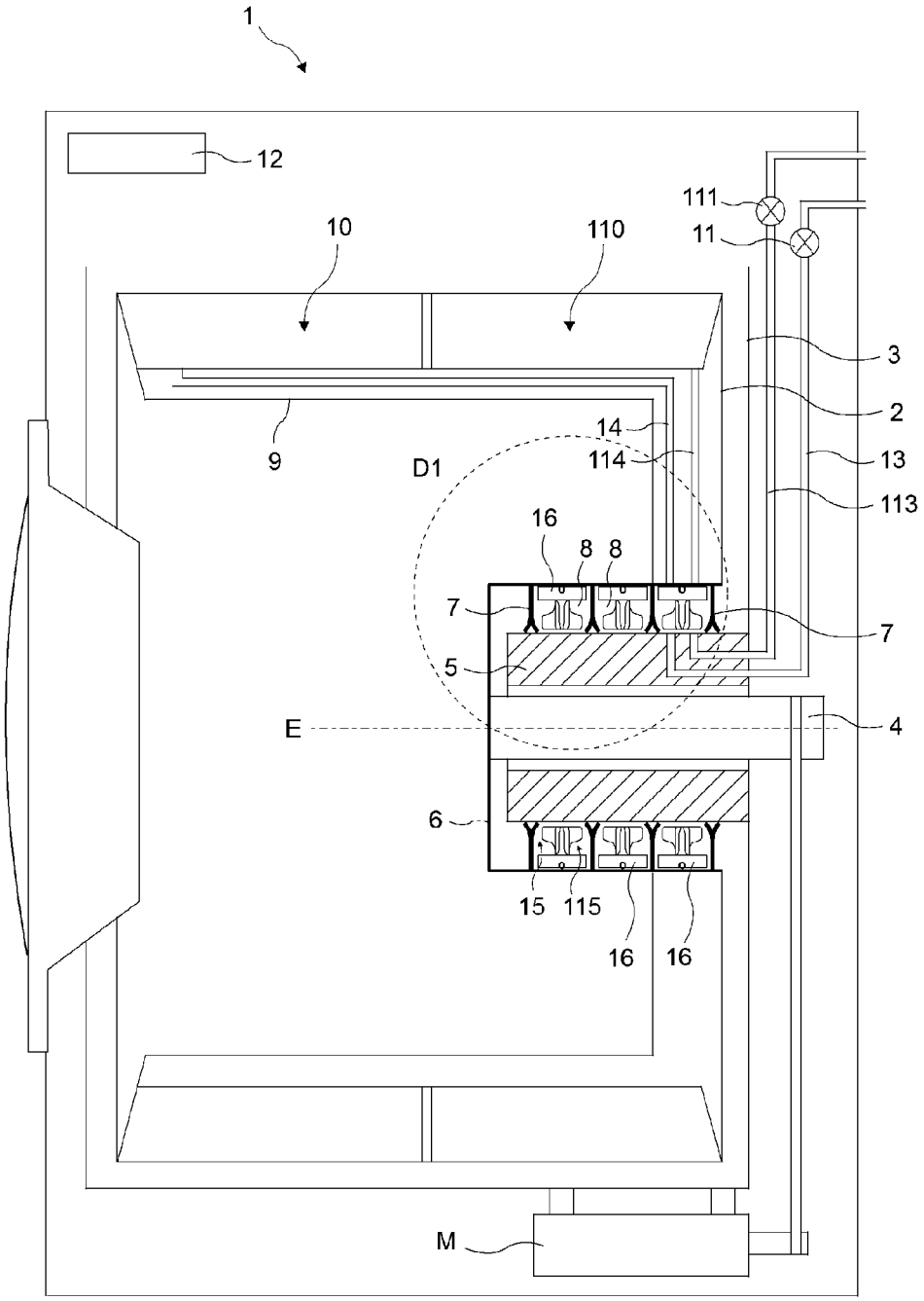

| | | | | | |
|---|---|---|---|---|---|
| 2,534,269 | A | * | 12/1950 | Ellner et al. | 74/572.4 |
| RE24,140 | E | * | 4/1956 | Kahn | 74/572.4 |
| 2,975,528 | A | * | 3/1961 | Shewmon | 34/601 |
| 5,280,660 | A | * | 1/1994 | Pellerin et al. | 8/158 |
| 5,582,040 | A | * | 12/1996 | Khan | 68/23.2 |
| 6,626,014 | B2 | * | 9/2003 | Heyder et al. | 68/140 |
| 2004/0083774 | A1 | * | 5/2004 | Kinouchi et al. | 68/23.1 |
| 2010/0223962 | A1 | * | 9/2010 | Hasanreisoglu | 68/200 |
| 2011/0197462 | A1 | * | 8/2011 | Hasanreisoglu | 34/90 |
| 2012/0222455 | A1 | * | 9/2012 | Hasan-Reisoglu et al. | 68/142 |

* cited by examiner

WASHING MACHINE WHEREIN THE UNBALANCED LOAD IS BALANCED

The present invention relates to a washing machine wherein the unbalanced load inside the drum is balanced by using water.

In washing machines having drums rotating around the horizontal axis, in different steps of the washing program, the washing process is performed by the drum being rotated at different speeds. While the drum is being rotated, an uneven load distribution occurs as a result of the laundry piling up at some areas. Especially in the spin-drying step wherein the drum is rotated at high speeds, the unbalanced load resulting from the laundry and structural factors increases vibration and noise, and cause the washing machine to wear out. Furthermore, the spin-drying performance of the washing machine is adversely affected.

In the state of the art, various solutions have been developed for balancing the unbalanced load. Connecting balancing weights produced from heavy materials such as concrete or metal to the tub of the washing machine is a commonly used method. Since the balancing weights make the transportation of the washing machine difficult, water is used to realize the balancing operation in some embodiments. Water is filled into the balancing chambers formed on the tub or the drum in order to balance the detected unbalanced load, and emptied when the unbalanced load is eliminated. Using water to balance the unbalanced load also causes some problems. Particularly, since a significant number of materials and sealing elements should be used in order to transfer water to the regions where balancing will be performed, cost increases, moreover since elements used covers much space inside the washing machine, laundry capacity may decrease. In the state of the art embodiments, water taken from the outside for the balancing operation is generally transferred to the chambers on the drum baffles by being passed through the hub of the drum and the tub where the shaft rotating the drum is supported. Water taken from the mains is delivered to the slots between the sealing elements placed in a sequence at the hub portion wherein the shaft is supported. If the number of baffles on the drum is (n) and if separate balancing process should be performed at front and rear chambers of the baffles, for (2n) front and rear balancing chambers, (2n) slots and (2n+1) sealing elements are needed. For example, since there are a total of 6 front and rear balancing chambers in the washing machine having a drum with 3 baffles, 6 slots and 7 sealing elements are needed to be used in order to deliver water to each balancing chamber, thereby cost increases and slots and sealing elements occupy much space, increase in the number of the sealing elements produced in highly fine tolerances increases cost and volume in the drum into which the laundry is placed decreases.

In state of the art Japanese Patent Application No. JP2002136792, an additional grooved element is described which bears against the shaft bearing and which provides water to be transferred to the baffles on the drum by being directed when there is unbalanced load. This additional element does not rotate and the water in the groove is delivered to the water storage tanks while the shaft bearing rotates by means of a channel.

In the state of the art International Patent Application No. WO2008/125498, delivering water to the baffles in the drum over the bearing wherein the drum shaft is supported for balancing is explained.

The aim of the present invention is the realization of a washing machine wherein the unbalanced load in the drum is precisely balanced by using water.

The washing machine realized in order to attain the aim of the present invention, explicated in the first claim and the respective claims thereof comprises the balancing chambers disposed in the drum baffles at the front and the rear sides, into which water is delivered in order to balance the unbalanced load occurred in the drum and the sealing gaskets and the slots which provide water to be distributed to the balancing chambers from the hub parts of the tub and the drum, and water taken from the outside for the balancing process is first delivered to the slots and then to the balancing chambers corresponding to each slot. Each slot is connected to a single drum baffle and each slot is separated into two divisions by a separator. Each division that the separator separates in the slot is connected to a balancing chamber disposed at the drum baffle and water is delivered from each division in the slot to the balancing chamber that the said division is connected to almost independently from the other division.

The separator is fixed to the inner surface of the housing which is a part of the drum surrounding the tub hub and the slots so as to completely surround the slot and concentrically rotates around the same axis together with the drum, the housing, the gaskets and the slots. The gaskets rotate around the tub hub and by rubbing the tub hub in order to provide leak-proofing. On the other hand, the separators, contrary to the gaskets, rotate around the drum hub without contacting the drum hub. Therefore, the separators are not needed to be produced from a friction resistant and expensive material like the gaskets.

The separator comprises a ring-shaped rim which is fixed to the inner surface of the housing completely surrounding the slots, which surrounds the divisions and which rotates around the slot together with the housing and a ring-shaped extension which is connected to the inner surface of the rim, which extends towards between the water inlet lines opening to the slot by passing through the slot from outside towards the inside in the radial direction and thus which divides the slot from almost the middle thereof in the radial direction into the divisions.

The separator, furthermore, comprises two orifices which are disposed on the rim, which overlap the distribution lines delivering water to the balancing chambers and rotate together with the distribution lines, the slot, the rim and the extension, which provide water applying pressure onto the inner surface of the rim by the effect of the centrifugal force to reach the distribution lines by passing through the rim in the radial direction.

In an embodiment of the present invention, the separator has blades which extend into the divisions from both sides of the extension at the inner side of the rim, which rotates together with the rim and which increase the centrifugal force affecting onto water directing onto the inner surface of the rim surrounding the division during the rotational movement. The blades extend flatly or curvedly at the inner side of the separator towards the inner surface of the rim. The effect of the curved blades to increase the centrifugal force affecting onto water delivered to the balancing chambers from the divisions is larger than the flat blades.

In another embodiment of the present invention, the separator comprises two channels which are disposed between the blades and the inner surface of the rim at both sides of the extension facing the divisions, which extend all around the inner surface of the rim and facilitates the transfer of the water along the inner surface of the rim.

In another embodiment of the present invention, the separator comprises a groove which extends all around the outer surface of the rim and which, by means of an o-ring mounted thereon, provides the separator to be attached to the inner surface of the housing in a leak-proof manner at the same level with the slots.

In the washing machine of the present invention, in case of an unbalanced load, water in an amount that compensates the unbalanced load and decreases the effect to minimum is taken from the mains and delivered to the slots between the gaskets placed at the hub part where the shaft rotating the drum is supported and transferred to the balancing chambers on the baffles from the slots. By means of the separator connected to each slot, two chambers in one blade are supplied from two different divisions in a single slot, thus a single slot serves as two separate slots, two balancing chambers in a drum baffle are supplied almost independently from each other from separate divisions in a single slot, thereby number of slots decreases. Accordingly, saving is provided by decreasing the number of the costly gaskets which are produced in fine tolerances. Moreover, by decreasing the space that the gasket-slot structure occupies, the laundry loading capacity of the drum is increased.

The washing machine realized in order to attain the aim of the present invention is illustrated in the attached figures, where:

FIG. 1—is the schematic view of a washing machine.

Figure 2:
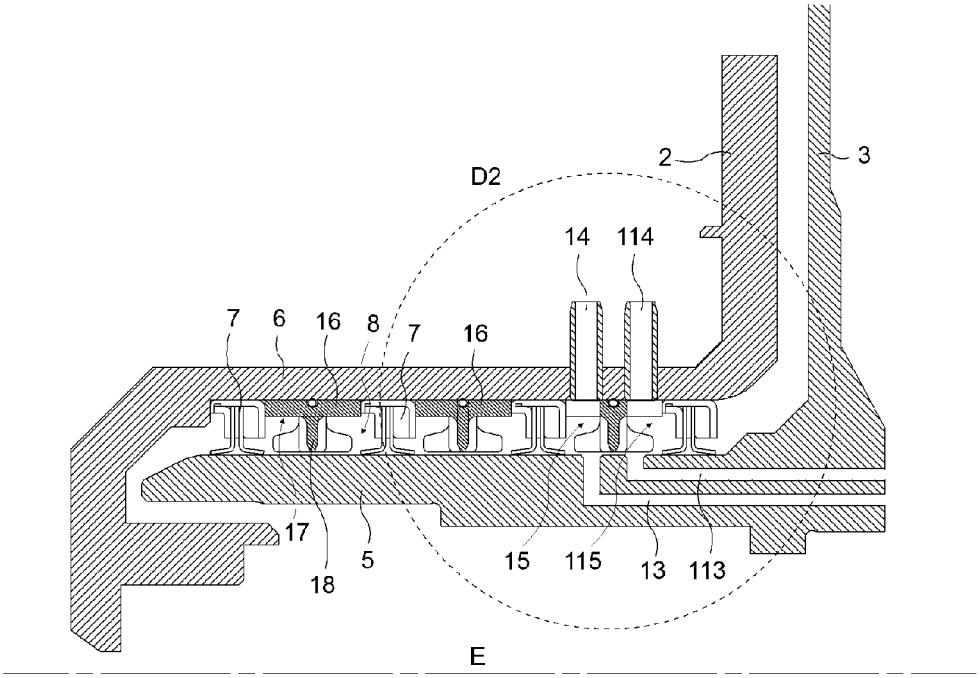

FIG. 2—is the view of detail D1 in FIG. 1.

Figure 3:
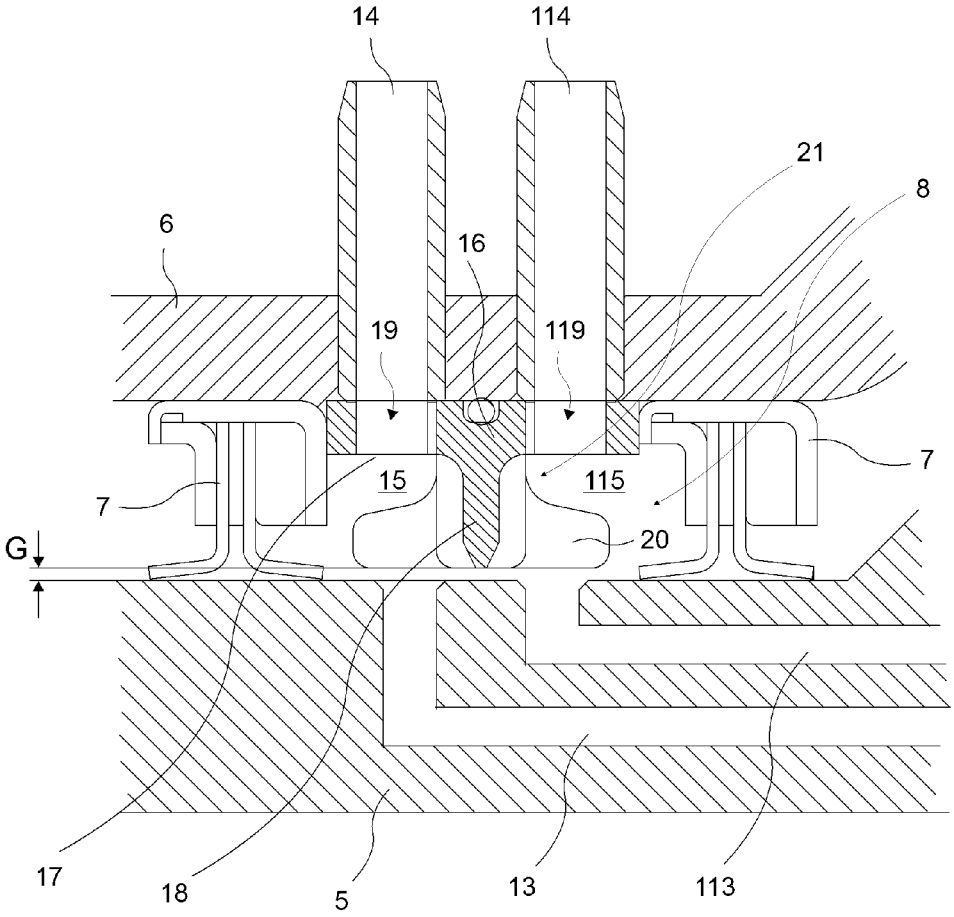

FIG. 3—is the view of detail D2 in FIG. 2.

Figure 4:
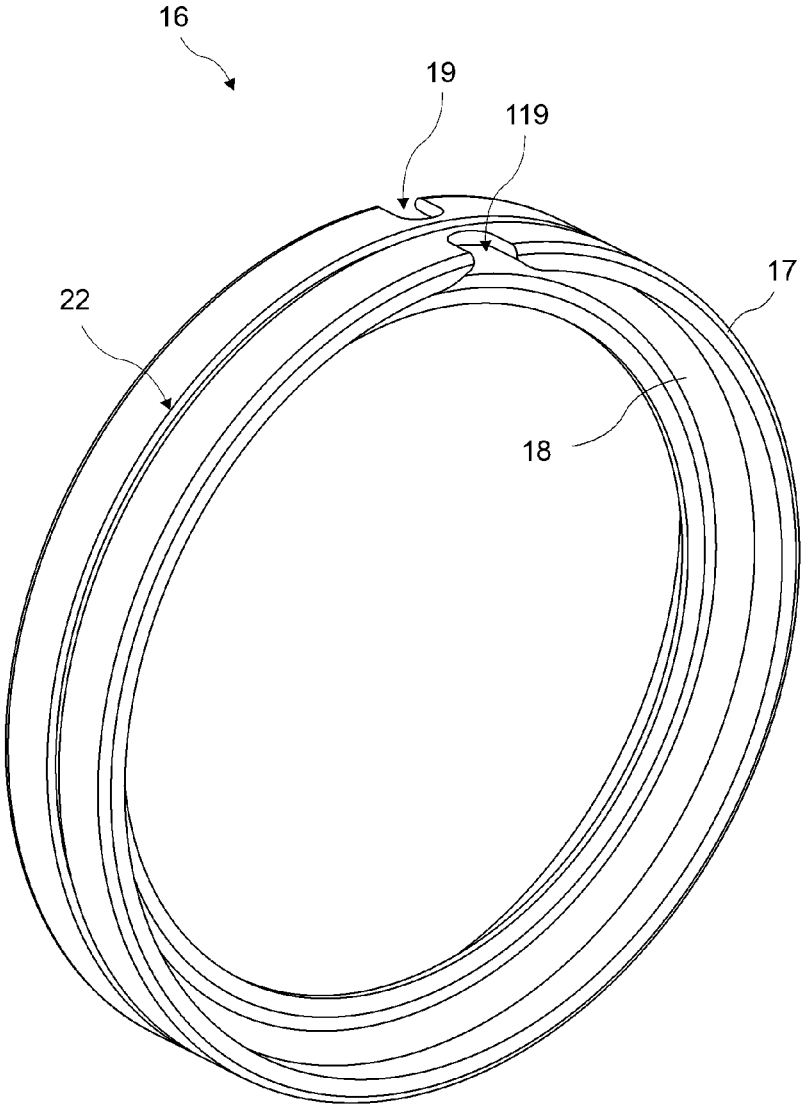

FIG. 4—is the perspective view of a separator.

Figure 5:
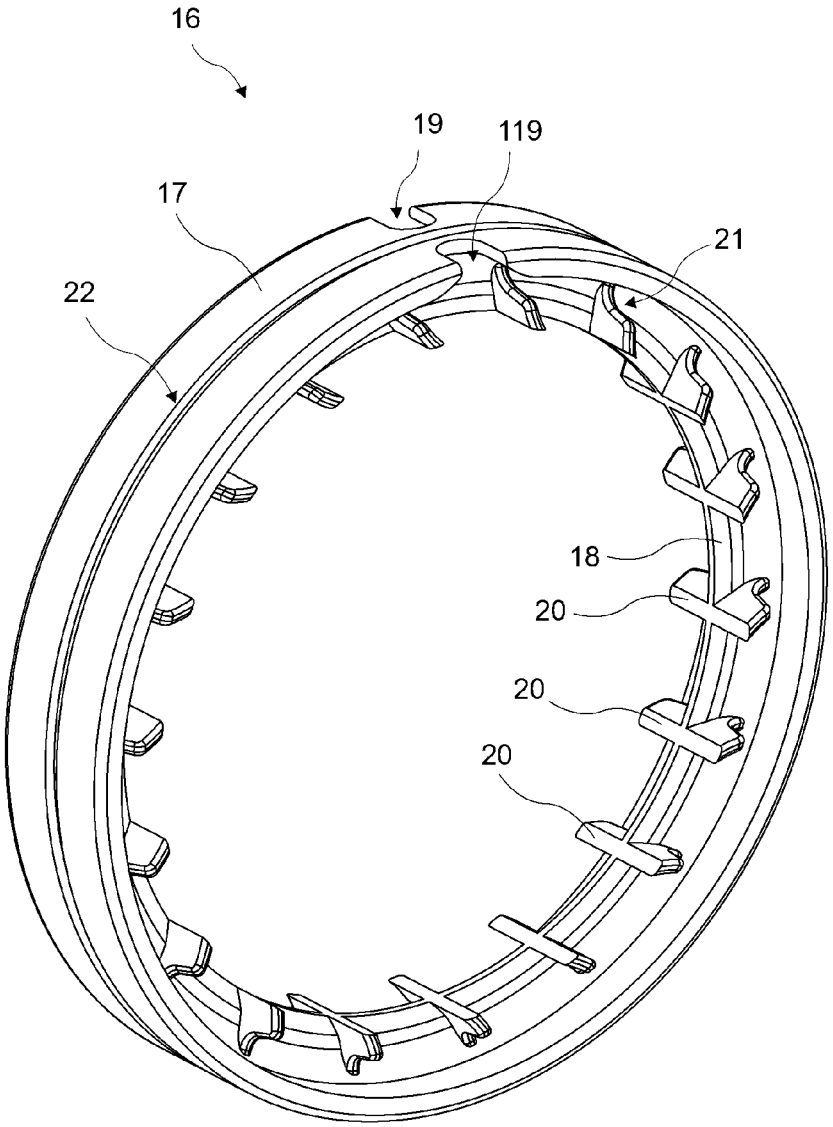

FIG. 5—is the perspective view of a separator at the inner side of which curved blades are disposed.

Figure 6:
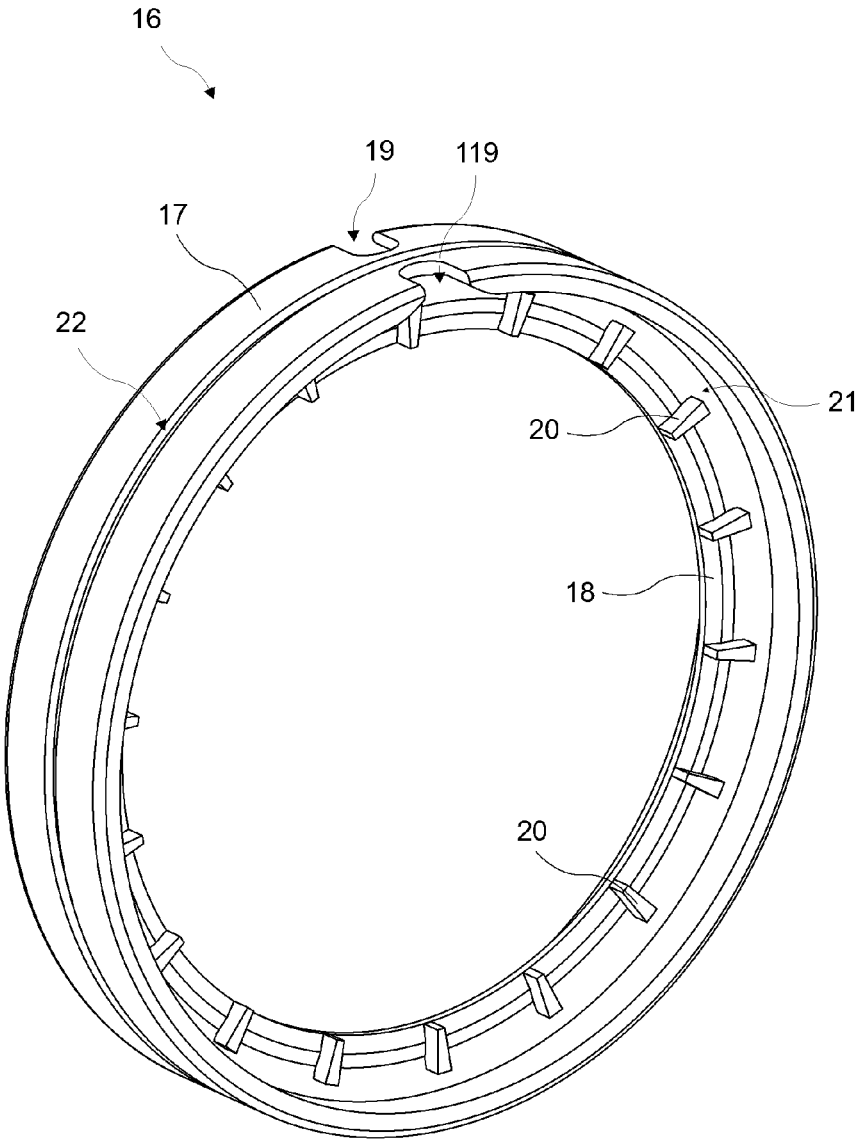

FIG. 6—is the perspective view of a separator comprising flat blades.

The elements illustrated in the figures are numbered as follows:

1. Washing machine
2. Drum
3. Tub
4. Shaft
5. Hub
6. Housing
7. Gasket
8. Slot
9. Drum baffle
10. 110 Chamber
11. 111, Water inlet valve
12. Control unit
13. 113, Water inlet line
14. 114, Water distribution line
15. 115, Division
16. Separator
17. Rim
18. Extension
19. 119 Orifice
20. Blade
21. Channel
22. Groove The washing machine (1) comprises a drum (2) rotated by a motor (M) around the horizontal axis (E), wherein the laundry is placed, a tub (3) wherein the drum (2) moves, a shaft (4) that transfers the movement received from the motor (M) to the drum (2), a hub (5) disposed at the center of the rear wall of the tub (3), which is stationary together with the tub (3) and wherein the shaft (4) is supported, a cylindrical housing (6) disposed at the center of the rear wall of the drum (2), surrounding the hub (5) concentrically and rotating together with the drum (2), more than one ring-shaped gasket (7) placed between the cylindrical inner surface of the housing (6) and the cylindrical outer surface of the hub (5), arranged one after the other and in parallel to each other, the outer edges of which are secured to the inner surface of the housing (6), rotating together with the housing (6) and the inner edges of which contact the cylindrical outer surface of the hub (5) so as to rotate around the hub (5) by rubbing against it, more than one slot (8) disposed between the gaskets (7) and arranged one after the other and in parallel to each to other between the housing (6) and the hub (5), at least one drum baffle (9) disposed at the inner surface of the drum (2), which provides the tumbling of the laundry, more than one chamber (10, 110) placed in the drum baffle (9) and wherein water is delivered according to the unbalanced load status, more than one water inlet valve (11, 111) which provides water to be delivered in necessary amount to the chambers (10, 110) from the water mains for the balancing process, a control unit (12) which opens/closes the water inlet valves (11, 111) by determining the amount and position of the unbalanced load when unbalanced load is detected and which determines how much water should be delivered into which drum baffle (9) and chamber (10, 110).

The washing machine (1) of the present invention comprises at least two water inlet lines (13, 113) opening into the slot (8) by passing through the hub (5) and which are stationary together with the tub (3), one end of each thereof connected to the water inlet valves (11, 111) and the other ends to the slot (8), at least two water distribution lines (14, 114), one end of each thereof connected to the slot (8) and the other ends to the chambers (10, 110) and which provide water to be delivered from the slot (8) to the chambers (10, 110), and at least one separator (16) which is placed between the two gaskets (7), which extends into the slot (8), which separates the slot (8) into at least two divisions (15, 115), which provides water received from the first water inlet line (13) to be delivered to the first division (15) and from there to the first water distribution line (14) and water received from the second water inlet line (113) to be delivered to the second division (115) and from there to the second water distribution line (114) and thereby which provides the chambers (10, 110) to be supplied from separate divisions (15, 115) in the same slot (8) almost independently from each other.

In the washing process in the washing machine (1), the control unit (12) detects the unbalanced load in the drum (2) and controls the operation of the water inlet valves (11, 111). The control unit (12) delivers water through the first water inlet line (13) by opening the first water inlet valve (11) upon detecting unbalance in the first chamber (10), water coming to the slot (8) fills only into the first division (15) by means of the separator (16) and is delivered to the first water distribution line (14) and from there to the first chamber (10) by means of the centrifugal force. The control unit (12) delivers water through the second water inlet line (113) by opening the second water inlet valve (111) upon detecting unbalance in the second chamber (110), water coming to the slot (8) fills only into the second division (115) by means of the separator (16) and is delivered to the second water distribution line (114) and from there to the second chamber (110) by means of the centrifugal force. A single slot (8) serves as two separate slots (8) by means of the separator (16), the separator (16) almost completely prevents the water passage from one division (15, 115) to the other division (15, 115) and water can be separately delivered to two chambers (10, 110) from each slot (8) by means of the divisions (15, 115).

The separator (16) comprises a ring-shaped rim (17) which is fixed to the cylindrical inner surface of the housing (6) between the gaskets (7) and which rotates together with the housing (6) and a ring-shaped extension (18) which is connected to the inner surface of the rim (17) and which extends, in the radial direction, towards between the water inlet lines (13, 113) opening to the slot (8) such that a gap (G) remains between the cylindrical outer surface of the hub (5) and the extension (18) (FIG. 3).

The gaskets (7) compressively contact the cylindrical outer surface of the hub (5) and rotate by rubbing in order to provide leak-proofing between the slots (8). Therefore, the gasket (7) is produced from a friction resistant and expensive material. The separator (16), on the other hand, is produced from a non-friction resistant and low-cost material since the extension (18) rotates without contacting the cylindrical outer surface of the hub (5). Since the separator (16) does not contact the outer surface of the hub (5), a small amount of water may pass from one division (15, 115) to the other division (15, 115) through the gap (G) between the separator (16) and the outer surface of the hub (5), however, water passing from one division (15, 115) to the other division (15, 115) is in a negligible amount and does not have any adverse effect on the balancing process.

The separator (16), furthermore, comprises at least two orifices (19, 119) which are disposed on the rim (17), which overlap with the water distribution lines (14, 114) and which rotate together with the housing (6) and the water distribution lines (14, 114), which provide water sticking onto the inner surface of the rim (17) by the effect of the centrifugal force to reach the water distribution lines (14, 114) by passing through the rim (17) in the radial direction (FIG. 3, FIG. 4, FIG. 5, FIG. 6).

Water coming from the water inlet line (13, 113) to the slot (8) and filling into the division (15, 115) that the separator (16) separates in the slot (8) sticks onto the inner surface of the rim (17) by the effect of the centrifugal force and reaches the water distribution line (14, 114) by means of the orifice (19, 119) from the inner surface of the rim (17) and then to the chamber (10, 110).

When the washing machine (1) is operated, the drum baffles (9), the housing (6), the gaskets (7), the slots (8), the distribution lines (14, 114) and the separators (16) rotate together with the drum (2) around the horizontal axis (E). The gaskets (7) contact the hub (5), but the separators (16) do not contact the hub (5). When the unbalanced load is detected by the control unit (12), the amount and the position of the unbalanced load and to which chamber (10, 110) in which baffle (9) water should be delivered is determined, then first necessary amount of water is taken from the water mains by operating the water inlet valves (11, 111) and water is delivered by means of the water inlet lines (13, 113) to the division (15, 115) in connection with the chamber (10, 110) wherein the unbalance is detected. Water reaching the related division (15, 115) reaches the related chamber (10, 110) by means of the related orifice (19, 119) and the related water distribution line (14, 114) without passing to the other division (15, 115) in the same slot (8) or by passing in a small amount through the gap (G) by means of the separator (16).

In an embodiment of the present invention, the separator (16) comprises more than one blade (20) which is connected to the extension (18) in the inner side of the rim (17), which extends into the divisions (15, 115) from both sides of the extension (18), which rotates together with the rim (17) and the extension (18), which increase the speed of water delivered to the water distribution line (14, 114) from the division (15, 115) by increasing the centrifugal force affecting water heading toward the inner surface of the rim (17) during the rotational movement (FIG. 5, FIG. 6).

In another embodiment of the present invention, the blades (20) extend towards the inner surface of the rim (17) in the radial direction at both sides of the extension (18) (FIG. 6).

In another embodiment of the present invention, the blades (20) extend towards the inner surface of the rim (17) in a curved manner in comparison with the radial direction at both sides of the extension (18) (FIG. 5). The curved blades (20) provide water to be delivered at an increased speed to the inner surface of the rim (17) and to the water distribution line (14, 114) by means of the orifice (19, 119) by increasing the centrifugal force affecting water in the divisions (15, 115) more than the flat blades (20).

In another embodiment of the present invention, the separator (16) comprises two channels (21) which are formed by cutting-out the portions of the blades (20) near the inner surface of the rim (17) or by producing the blades (20) in recessed form at both sides of the extension (18), which extend all around the inner surface of the rim (17) and which provide water in the division (15, 115) during the rotational movement and the effect of the centrifugal force thereon of which is increased by the blades (20) to reach the orifice (19, 119) on the inner surface of the rim (17) (FIG. 3, FIG. 5).

Water reaching the division (15, 115) through the water inlet line (13, 113) continues its movement in the radial direction and first reaches the blades (20) disposed in the division (15, 115) and then to the channel (21). Water reaching the channel (21) applies pressure onto the inner surface of the rim (17) with the effect of the centrifugal force and quickly passes to the water distribution line (14, 114) by means of the orifice (19, 119).

In another embodiment of the present invention, the separator (16) comprises a groove (22) which extends all around the outer surface of the rim (17) and which, by means of an o-ring mounted thereon, provides the separator (16) to be attached to the inner surface of the housing (6) in a leak-proof manner at the same level with the slots (8) (FIG. 4, FIG. 5, FIG. 6).

In the washing machine (1) of the present invention, in case of the unbalanced load detected by the control unit (12), water in an amount to compensate the unbalanced load and decrease the effect thereof to a minimum is taken from the mains and delivered to the related divisions (15, 115) in the slots (8) disposed between the gaskets (7) placed at the portion wherein the shaft (4) rotating the drum (2) is supported by means of the water inlet lines (13, 113) and then is transferred to the chambers (10, 110) from the divisions (15, 115) by means of the water distribution lines (14, 114). The separator (16) separating each slot (8) into two divisions (15, 115) provides that the chambers (10, 110) are supplied from a single slot (8) almost independently from each other, utilization of separate slots (8) for supplying each chamber (10, 110) is no more required and thus cost is decreased by using fewer number of slots (8) and gaskets (7) in comparison with the state of the art embodiments. By means of the separator (16), water in an amount that does not affect the unbalancing process passes from one division (15, 115) to the other division (15, 115) in the slot (8) through the gap (G) between the separator (16) and the hub (5). Thus, one slot (8) serves as two separate slots (8), two chambers (10, 110) in one drum baffle (9) are supplied from a single slot (8), number of slots (8) and thus of costly gaskets (7) the production of which is difficult is decreased, saving is provided by using fewer number of gaskets (7) instead of a larger number of gaskets (7) and low-cost separators (16).

It is to be understood that the present invention is not limited by the embodiments disclosed above and a person skilled in the art can easily introduce different embodiments. These should be considered within the scope of the protection postulated by the claims of the present invention.

The invention claimed is:

1. A washing machine (1) comprising:

a drum (2) rotated by a motor around the horizontal axis, a tub (3) wherein the drum (2) moves, a shaft (4) that transfers the movement received from the motor to the drum (2), a hub (5) disposed at the center of a rear wall of the tub (3) around the horizontal axis, which is stationary together with the tub (3) and wherein the shaft (4) is supported, a cylindrical housing (6) disposed at the center of the rear wall of the drum (2) around the horizontal axis, surrounding the hub (5) concentrically and rotating together with the drum (2), at least two ring-shaped gaskets (7) placed between the cylindrical inner surface of the housing (6) and the cylindrical outer surface of the hub (5), arranged one after the other and in parallel to each other, at least two slots (8) disposed between the gaskets (7), at least one drum baffle (9) disposed at the inner surface of the drum (2), at least two chambers (10, 110) placed in the drum baffle (9) and wherein water is delivered according to the unbalanced load status, at least one water inlet valve (11, 111) which provides water to be delivered in necessary amounts to the chambers (10, 110) from the water mains for a balancing process, a control unit (12) which opens/closes the water inlet valves (11, 111) by determining the amount and position of the unbalanced load when the unbalanced load is detected and which determines how much water should be delivered into which baffle (9) and chamber (10, 110), wherein at least a first water line and a second water line (13, 113) open into the at least one of the at least two slots (8) by passing through the hub (5) and are stationary together with the tub (3), one end of each thereof connected to the water inlet valves (11, 111) and the other ends to the at least one of the at least two slots (8), at least two water distribution lines (14, 114), one end of each thereof connected to the at least one of the at least two slots (8) and the other ends to the chambers (10, 110), which provide water to be delivered from the slot (8) to the chambers (10, 110), and at least one separator (16) which is placed between the at least two ring-shaped gaskets (7), which extends into the at least one of the at least two slots (8), which separates the at least one of the at least two slots (8) into at least a first division and at least a second division (15, 115), which provides water received from the first water inlet line (13) to be delivered to the first division (15) and to the first water distribution line (14) and water received from the second water inlet line (113) to be delivered to the second division (115) and to the second water distribution line (114) and thereby which provides the chambers (10, 110) to be supplied from separate divisions (15, 115) in the at least one of the at least two slots (8) almost independently from each other.

2. The washing machine (1) as in claim 1, wherein the separator (16) further comprises a ring-shaped rim (17) which is fixed to the cylindrical inner surface of the housing (6) between the gaskets (7) and which rotates together with the cylindrical housing (6) and a ring-shaped extension (18) which is connected to the inner surface of the ring-shaped rim (17) and which extends, in the radial direction, towards between the first water line and a second water line (13, 113) opening to the at least one of the at least two slots (8) such that a gap (G) remains between the cylindrical outer surface of the hub (5) and the ring-shaped extension (18).

3. The washing (1) as in claim 1 or 2, wherein the separator (16) comprises at least two orifices (19, 119) which are disposed in the ring-shaped rim (17) and which overlap with the water distribution lines (14, 114), which provide water sticking onto the inner surface of the ring-shaped rim (17) by the effect of the centrifugal force to reach the water distribution lines (14, 114) by passing through the ring-shaped rim (17) in the radial direction.

4. The washing (1) as in claim 3, wherein the separator (16) comprises at least two blades (20) which extend into the divisions (15, 115) from both sides of the ring-shaped extension (18) in the inner side of the ring-shaped rim (17), which rotates together with the ring-shaped rim (17) and the ring-shaped extension (18), which increases the centrifugal force affecting water heading toward the inner surface of the ring-shaped rim (17) during the rotational movement.

5. The washing (1) as in claim 4, wherein the separator (16) includes the at least two blades (20) disposed at both sides of the ring-shaped extension (18) and extending towards the inner surface of the ring-shaped rim (17) in the radial direction.

6. The washing (1) as in claim 4, wherein the separator (16) includes the at least two blades (20) disposed at both sides of the ring-shaped extension (18) and extending towards the inner surface of the ring-shaped rim (17) in a curved manner in comparison with the radial direction.

7. The washing (1) as in claim 4, wherein the separator comprises two channels (21) which are formed by cutting-out the portions of the at least two blades (20) near the inner surface of the ring-shaped rim (17) or by producing the at least two blades (20) in recessed form at both sides of the ring-shaped extension (18) facing the divisions (15, 115), which extend all around the inner surface of the ring-shaped rim (17).

8. The washing (1) as in claim 4, wherein the separator (16) comprises a groove (22) which extends all around the outer surface of the ring-shaped rim (17) and which, by means of an o-ring mounted thereon, provides the separator (16) to be attached to the inner surface of the housing (6) in a leak-proof manner.

9. The washing (1) as in claim 1, wherein the separator (16) comprises at least two blades (20) which extend into the divisions (15, 115) from both sides of the ring-shaped extension (18) in the inner side of the ring-shaped rim (17), which rotates together with the ring-shaped rim (17) and the ring-shaped extension (18), which increases the centrifugal force affecting water heading toward the inner surface of the ring-shaped rim (17) during the rotational movement.

10. The washing (1) as in claim 9, wherein the separator (16) includes the at least two blades (20) disposed at both sides of the ring-shaped extension (18) and extending towards the inner surface of the ring-shaped rim (17) in the radial direction.

11. The washing (1) as in claim 9, wherein the separator (16) includes the at least two blades (20) disposed at both sides of the ring-shaped extension (18) and extending towards the inner surface of the ring-shaped rim (17) in a curved manner in comparison with the radial direction.

12. The washing (1) as in claim 9, wherein the separator (16) comprises two channels (21) which are formed by cutting-out the portions of the at least two blades (20) near the inner surface of the ring-shaped rim (17) or by producing the at least two blades (20) in recessed form at both sides of the ring-shaped extension (18) facing the divisions (15, 115), which extend all around the inner surface of the ring-shaped rim (17).

13. The washing (1) as in claim 9, wherein the separator (16) comprises a groove (22) which extends all around the outer surface of the ring-shaped rim (17) and which, by means of an o-ring mounted thereon, provides the separator (16) to be attached to the inner surface of the housing (6) in a leak-proof manner.

14. The washing (1) as in claim 1, wherein the separator (16) comprises a groove (22) which extends all around the outer surface of the ring-shaped rim (17) and which, by means of an o-ring mounted thereon, provides the separator (16) to be attached to the inner surface of the housing (6) in a leak-proof manner.

* * * * *